United States Patent [19]

Kelly

[11] 4,125,106

[45] Nov. 14, 1978

[54] ELASTIC POWERED CATAPULT

[76] Inventor: Ward L. Kelly, 4851 Coastal Ave., Bodega Bay, Calif. 94923

[21] Appl. No.: 745,844

[22] Filed: Nov. 29, 1976

[51] Int. Cl.[2] ..... F41B 7/00

[52] U.S. Cl. ..... 124/17; 124/41 R

[58] Field of Search ..... 124/17, 20 R, 41 R, 124/49, 50, 83, 80, 1, 22, 21, 85; 273/119 R, 129; 46/74 R

[56] References Cited

U.S. PATENT DOCUMENTS

| | | | |
|---|---|---|---|
| 849,554 | 4/1907 | Middleton | 124/21 |
| 1,866,158 | 7/1932 | Goodwin | 124/20 R UX |
| 1,978,799 | 10/1934 | Lefever | 124/85 |
| 2,324,201 | 7/1943 | Donaldson | 124/20 R |
| 2,757,658 | 8/1956 | Harris | 124/17 |

*Primary Examiner*—William R. Browne
*Attorney, Agent, or Firm*—Melvin R. Stidham

[57] ABSTRACT

A hand operated, elastic powered catapult, including a tubular barrel carried on a hand grip and a generally conical, elastic power chamber. The open end of the power chamber is stretched around the muzzle end of the barrel and secured by a locking ring to extend back through the barrel where the closed apex may be gripped. The convex conical power chamber is composed of two conical surfaces that merge into each other a generally cylindrical projectile pocket receiving a spherical pellet. When the power chamber is stretched back and released, the pellet is projected at high velocity from the barrel.

8 Claims, 3 Drawing Figures

ELASTIC POWERED CATAPULT

BACKGROUND OF THE INVENTION

Catapults directly powered by an elastic material such as the conventional slingshot, have certain limitations inherent therein. For example, the velocity of the projectile propelled therefrom is limited to the velocity of the retraction or recovery of the elastic material used therein. In addition, the configuration of most elastic materials, such as latex, is not stable or uniform during their recovery from distension. That is, certain portions of the material tend to recover more rapidly than other portions making the overall recovery from distension uneven and inconsistent. In addition, latex and other elastic materials commonly used in catapults of this type are very fragile and tend to tear when their surface is broken by even minute cuts or abrasions. For this reason, directly powered elastic catapults must utilize a receptacle of another material to receive the projectile, e.g. the leather pouch of a typical slingshot.

OBJECTS OF THE INVENTION

It is an object of this invention to provide a directly powered elastic catapult which is reliable and durable in operation.

It is a further object of this invention to provide a directly powered elastic catapult which is conditioned for stable recovery from distention.

It is a further object of this invention to provide an directly powered elastic catapult which can propel a projectile at velocities in excess of the velocity of recovery of the elastic itself.

It is a further object of this invention to provide an elastic powered catapult which is greatly resistant to rupture.

It is a further object of this invention to provide an elastic powered catapult which is reliable and accurate in operation.

Other objects and advantages of this invention will become apparent from the description to follow, particularly when read in conjunction with accompanying drawings.

BRIEF SUMMARY OF THE INVENTION

In carrying out this invention I provide a hand-operated, elastic powered catapult which includes a cylindrical barrel mounted on a handgrip. A generally conical elastic power chamber has a retention ridge adjacent the open end thereof which is in a plane precisely perpendicular to the axis of the cone, whereby when the open end over the muzzle end of the barrel and held in place by an elastic retaining ring engaging between the ridge and a complementary shoulder on the barrel, the power chamber is precisely centered on the cylindrical barrel. Inasmuch as a latex member tends to distend progressively from an initially distended portion, the distension of the boot progresses from the forward open end portion which is initially stretched around the barrel. The convexly conical portion of the elastic power chamber tends to inhibit inward collapse of the power chamber during distension, and this inward collapse is further inhibited by the above-mentioned progressive distension of the power chamber and by a relatively thick generally cylindrical projectile pocket at the trailing end of the power cone. In addition to functioning as a reinforcing member preventing inward collapse, the thick trailing portion provides protection from tear and also provides a gripping member for distension of the power chamber.

DESCRIPTION OF A PREFERRED EMBODIMENT

Figure 1:
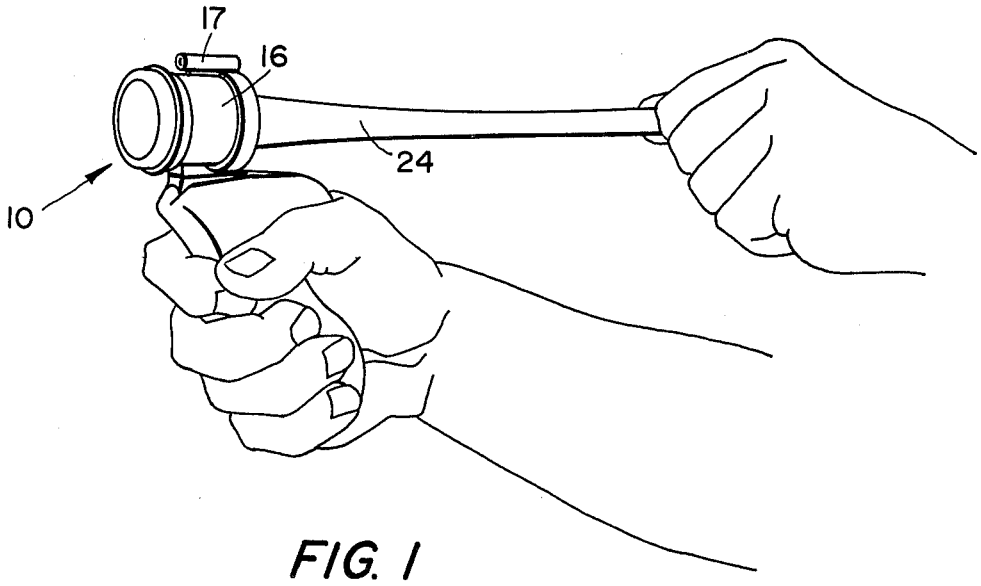
FIG. 1 is an isometric view showing the catapult of this invention in operation.

Referring to the drawings with greater particularity, the catapult 10 of this invention includes a handgrip 12 which may have finger notches 13 as desired, on which is carried a cylindrical barrel 16 having a small diameter sight tube 17 mounted thereon so that the axis of the sight tube 17 is in the plane of the vertical diameter of the barrel 16. The forward or muzzle end 18 of the barrel has a smooth rounded profile and immediately rearward thereof is a shoulder 20 for a purpose to be described. Stretched around the muzzle end 18 is the open end 22 of a generally conical, elastic power chamber 24 from which a projectile P may be propelled.

The particular configuration of the elastic concial power chamber 24 is a significant feature of this invention. First, the cone is formed with a circumferential ridge 26 on its normally interior surface adjacent the open end of the cone, which when the open is stretched and folded back over the barrel 16 forms an upstanding ridge. This ridge is formed by machining a groove in the dipping mandril, which is used to manufacture the elastic cone. Since the groove is formed by turning it on a lathe it is necessarily in a plane which is perpendicular to the axis of the mandril and, hence, the axis of the cone. This precise alignment of the ridge could not be assured if it was formed on the outer surface by treating with a separate member as is common with dipped parts. In any event, when the cone is positioned on the barrel the open end is stretched around the muzzle end 18 of the barrel and an elastic ring 28, such as an O-ring, is also stretched over the barrel to be positioned between the ridge 26 and the shoulder 20 on the muzzle end of the barrel. The ridge 26 and elastic retainer ring 28 are drawn up into engagement with the shoulder 20 and, as so positioned, the elastic cone is perfectly aligned with the axis of the barrel.

With the open end of the cone stretched around the barrel its muzzle portion is distended into a bell shape at **24*a* as shown, from a normal diameter smaller than the inner diameter of the barrel 16, that is, the muzzle end of conical power chamber is expanded even when the chamber is otherwise at rest. When a sausage-shaped latex ballon is inflated, it does not expand uniformly from end to end, but tends to bulge at one point and to then progressively expand from the intitially distended section. This characteristic is utilized in this invention by the normal muzzle distension referred to above to insure that elongation of the latex is initiated at the muzzle portion 24*a* and progresses rearward therefrom. Similarly, when the power chamber is released in the course of shooting the catapult 10, the high speed retraction of the latex occurs in the same order in which it was stretched, i.e. from muzzle to breech. This progressive recovery of the stretched latex is a factor in two important phenomena which greatly enhance the efficiency of the catapult of this invention. First, since the muzzle portion 24 and 24***e* of the power chamber recovers first ahead of the advancing projectile P, inward collapse of the power chamber walls 24*b*, 24*c* which would obstruct a projectile P moving therethrough, is inhibited. Second, as the power chamber begins to recover its undistended configuration, instead of crumbling against the rear portion of the barrel, it begins to protrude inside-out from the muzzle thereof. At that stage, residual energy again stretches the chamber progressively from the belled portion 24*a* to produce another roll through the barrel, thus returning the power chamber 24 to its original position.

Figure 3:
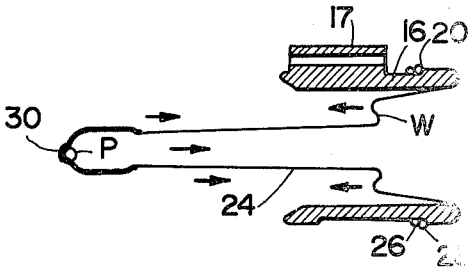
FIG. 3 is a schmatic view illustrating the operation of the catapult.

As the power chamber turns inside-out, a circumferential "S" wave W (FIG. 3) in the power chamber walls must, of course, travel down its entire length. A wave travelling a tapered form increases in velocity in proportion to the decrease in diameter. This is the phenomena which enables a tip of a whip to reach exceedingly high velocities, even in excess of sonic velocities, and it is this action which enables the catapult of this invention to exceed the velocity of the elastic material.

Moving rearward from the distended belled portion, the normal configuration of the elastic power tube is nearly cylindrical at 24*b* then merging successively into a convexly conical portion 24*c*, a slightly concave portion 24*d*, and finally a near cylindrical projectile pocket 24*e*. The convex walls of the tapered section not only inhibit the inward collapse of the walls during the shooting sequence, but also as a matter of simple geometry, allow the wave to travel the length of the power chamber without obstructing its reversal or the movement of the projectile. It is analogus to everting a conical windsock as compared to everting a cylindrical tube. This is particularly important with a power chamber which has a substantial length relative to its diameter. If the power chamber 24 was configurated as a cylinder or a uniformly tapered tube, its walls would tend to collapse inward and obstruct the projectile P unless, of course, it was very short in relation to its diameter. However, this would means a short draw length and extreme wind resistance.

Figure 2:
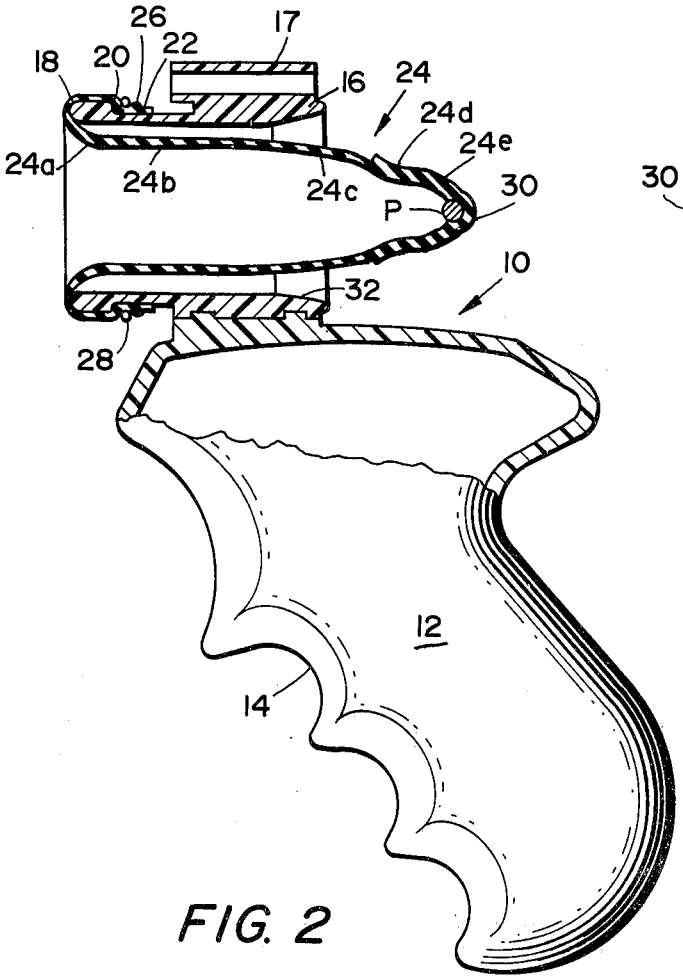
FIG. 2 is a side view partially broken away of the catapult.

It will be noted in FIG. 2 that the projectile pocket 24*e* is very nearly cylindrical and has a wall thickness greater than that of the remainder of the power chamber. This has a three-fold function. First, it provides a finger grip portion which, because of the thickness stretches very little, thus protecting the walls from tears due to finger abrasion, and is more comfortable to hold. Secondly, this thick wall section extends forward to merge with the convexly conical portion and, therefore, acts in the nature of a reinforcing member to support such conical portion and aid in the critical function of preventing the internal collapse of the walls while the projectile P is being launched. Thirdly, the back wall of the receptacle has an even heavier wall which includes a small internal pocket or depression which performs a very important function.

Ammunition commonly used in catapults of this nature comprises air rifle shot or BB's which generally have a flat or dimpled spot which may have a relatively sharp edge produced in the cold forming process used in their manufacture. This relatively sharp edge could very readily cut the surface of the latex causing it to tear rapidly. However, the latex will withstand considerable contact and pressure from the projectile's sharp spot, if the latex is not stretched during this contact. One factor which prevents this stretching during contact with the projectile is the extra thickness of the latex at the tip. The other factor is the configuration of this portion with its small receptacle 30 providing a washer-like member which is gripped by the fingers rather than the BB itself. When the fingers holding the power chamber release their pressure, the tension of the latex quickly draws the end of the power chamber through the fingers and, ordinarily, this could cause great strain on the tip of the power chamber as the projectile was pulled through, However, with this construction, it is simply the chamber itself which is released to carry the projectile with it.

The breech 32 of the barrel has an internal taper which functions as a forcing cone or camming member if the power chamber is drawn back and released out of line with the bore of the barrel. The longtitudenal sight tube 17 on the top surface of the barrel, not only functions as a sight, but by reason of its parallax, helps the shooter align the barrel with the extended power chamber.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. A hand operated catapult comprising:

a hand grip;

a rigid annular member carried on said hand grip; and a projectile propulsion power chamber of elastic material secured around said annular member and extending rearwardly therefrom;

said power chamber being generally cylindrical adjacent said annular member, the end of the chamber remote from the annular member merging into a first frusto-conical section with convex outer surface the convex outer surface merging into a second frusto-conical section and the rear most end of the concave outer surface merging into a projectile pocket.

2. The catapult defined by claim 1 wherein:

said projectile pocket is generally cylindrical and is formed thicker than the remainder of said power chamber.

3. The catapult defined by claim 2 including:

a projectile recess in the rear wall of said projectile pocket.

4. The catapult defined by claim 1 including:

releasable means securing the open end of said power chamber around said annular member.

5. The catapult defined by claim 1 wherein:

said annular member is a short cylindrical barrel;

a shoulder around said barrel adjacent the leading, annular edge thereof.

the open end of said power chamber being stretched over said shoulder and then folded back to extend through said barrel;

a ridge around the normally-interior surface of said power chamber adjacent said open end; and a locking ring around said open end and barrel disposed and engaged between said ridge and said shoulder.

6. The catapult defined by claim 5 wherein:

said locking ring is of an elastomeric material.

7. The catapult defined by claim 5 including a narrow sight tube on said barrel with the axis thereof in the plane of the vertical radius of said barrel.

8. The catapult defined by claim 1 wherein: said power chamber is formed of latex.

* * * * *